US006359230B1

(12) United States Patent
Hildreth

(10) Patent No.: US 6,359,230 B1
(45) Date of Patent: Mar. 19, 2002

(54) AUTOMOTIVE-WIRE INSULATION

(75) Inventor: Nelson Hildreth, Venice, FL (US)

(73) Assignee: Champlain Cable Corporation, Colchester, VT (US)

( * ) Notice: Subject to any disclaimer, the term of this patent is extended or adjusted under 35 U.S.C. 154(b) by 0 days.

(21) Appl. No.: 09/468,432

(22) Filed: Dec. 21, 1999

(51) Int. Cl.[7] ..... H01B 7/00

(52) U.S. Cl. ..... 174/110 R; 174/120 R; 174/120 C

(58) Field of Search ..... 174/110 R, 110 FC, 174/110 PM, 110 F, 113 R, 120 R, 120 C, 120 SC, 121 A

(56) References Cited

U.S. PATENT DOCUMENTS

| | | | | | |
|---|---|---|---|---|---|
| 3,870,987 | A | * | 3/1975 | Wiley et al. | 338/214 |
| 4,521,485 | A | | 6/1985 | Tondre et al. | 428/383 |
| 4,801,501 | A | | 1/1989 | Harlow | 428/383 |
| 4,988,835 | A | | 1/1991 | Shah | 174/117 F |
| 5,059,483 | A | | 10/1991 | Lunk et al. | 428/383 |
| 5,161,427 | A | * | 11/1992 | Fukuda et al. | 74/502.4 |
| 5,281,766 | A | | 1/1994 | Hildreth | 174/120 R |
| 5,326,935 | A | | 7/1994 | Yamaguchi et al. | 174/120 R |
| 5,358,786 | A | | 10/1994 | Ishikawa et al. | 174/117 F |
| 5,362,925 | A | | 11/1994 | Yamaguchi et al. | 174/120 R |
| 5,371,325 | A | | 12/1994 | Kalola et al. | 174/117 F |
| 5,426,264 | A | | 6/1995 | Livingston et al. | 174/102 R |
| 5,462,803 | A | | 10/1995 | Wessels | 428/380 |
| 5,521,009 | A | | 5/1996 | Ishikawa et al. | 428/375 |
| 5,670,748 | A | * | 9/1997 | Gingue et al. | 174/120 R |
| 5,841,072 | A | | 11/1998 | Gagnon | 174/110 F |
| 6,015,858 | A | * | 1/2000 | Gornowicz | 524/545 |
| 6,017,626 | A | * | 1/2000 | Hildreth | 428/373 |
| 6,063,496 | A | * | 5/2000 | Jozokos et al. | 428/379 |
| 6,080,929 | A | * | 6/2000 | Fagouri et al. | 174/23 C |

* cited by examiner

*Primary Examiner*—Dean A. Reichard
*Assistant Examiner*—William H. Mayo, III
(74) *Attorney, Agent, or Firm*—Salzman & Levy

(57) ABSTRACT

The invention pertains to multi-layer polymeric formulations for protecting or insulating metallic objects, and, more particularly, to an integrated, tri-layer, thin-wall insulation composite, for use in a high temperature, automotive-wire article. The tri-layer design comprises an inner layer of a fluoropolymer, polyether sulfone, polyether-ketone, polyetherimide, or thermoplastic polyester; a middle layer comprising a polyolefin; and an outer layer comprising a fluoropolymer. The inner and outer layers serve to protect the middle polyolefinic layer from degradation.

37 Claims, 4 Drawing Sheets

AUTOMOTIVE-WIRE INSULATION

FIELD OF THE INVENTION

The invention pertains to multi-layer polymeric formulations for protecting or insulating metallic objects and more particularly, to an integrated, tri-layer, thin-wall insulation composite, for use in a high temperature, automotive-wire article.

BACKGROUND OF THE INVENTION

Applying polymeric formulations to the surface of metallic objects has been a long practiced art. Typically, this is performed for several different reasons. Firstly, metallic objects are prone to oxidation or other chemical attack of their surfaces, degrading the utility of the metal object. Secondly, metals are inherently electrically conductive, metallic articles used for this purpose must be insulated to maintain the integrity of the electrical circuit. Examples of applications of such articles include such diverse uses as building wire, aircraft wire, plenum wiring for local area network computers and communication, transformer wiring for isolating magnetic and electrical wiring, underground wiring, and electrical conductive wiring for automotive and general electrical machinery.

Useful materials for covering metallic objects for the above purposes are organic polymer formulations. However, because of the varied uses of these metallic articles and the conditions that they are subjected to, it is difficult to find an ideal organic polymeric formulation that will itself survive under such conditions and uses, yet still provide a multitude of critical properties. Common properties include such physical and chemical characteristics as durability, flexibility, elasticity, toughness, adhesion, thermal stability, chemical resistance, flame retardance and minimal smoke generation. In some cases the protective layer may even be required to have properties that seem almost to be antipodal (e.g., abrasion resistance and flexibility).

Of the plethora of organic polymer compositions that are known or theoretically available, derivatives of polyethylene, especially crosslinked polyethylene, have secured a significant share of the market for these applications. Polyethylene homo- and copolymers offer a wide range of beneficial properties especially with regard to flexibility and elasticity. The common non-halogenated polyethylenes are also inexpensive to produce and relatively easy to process. However, they typically have poor abrasion resistance and impact resistance. To a degree this can be improved by crosslinking, but a trade-off in other properties are then observed. Lastly, and in some cases most importantly, the unhalogenated polyethylene derivatives are not chemically inert and will degrade under a variety of conditions. This degradation is observed during aerial exposure and on contact to certain metals, in particular, copper. Degradation is accelerated when the polyethylene derivatives are stressed, for example under elevated temperatures or physical distortion. Halogenated polyethylenes, specifically fluorinated derivatives, have superior chemical inertness; however, they suffer from poor adhesive properties and are extremely costly.

There is still a long standing need to find a polymeric system that will provide all the properties required for a metal protectant or insulation especially in uses that are physically stressful, that require longlife, that involve human safety, and that are difficult to replace. A number of these criteria exists for high-temperature insulation for automotive wiring.

Automotive wire located under the hood in the engine compartment (engine wire) has traditionally been insulated with a single layer of high-temperature insulation that is disposed over an uncoated copper-wire core. The U.S. specification that is usually used for this wire is SAE J1128, rev. January 1995 type TXL. The high temperature requirements for type TXL insulation, which require specific tensile and elongation standards as well, specifies that the insulation be oven aged without the conductor at 155° C. for 168 hours.

For certain newer automobiles, the high temperature specified for type TXL insulation is not sufficient to cover the actual temperatures existing in automobile engine compartments. The new requirements for engine wire range from 135° C. to 180° C. A typical test procedure now required is aging the insulation with the conductor for 3,000 hours at 150° C. as specified in International Standard ISO 6722-1- and 6722-2, rev. January 1996.

Most of the high-temperature wire used as engine wire in North America uses crosslinked polyethylenes (XLPE) as the insulation material. European manufacturers have obtained good high-temperature performance (3,000 hrs. at 155° C.) using thermoplastic polyesters. This insulation has outstanding resistance to gas and oil, is mechanically tough, and resists copper catalyzed degradation. Thermoplastic polyesters, however, can prematurely fail, because of hydrolysis. Thermoplastic polyester insulated wires have also been found to crack when exposed to hot salty water. They have also failed temperature humidity cycling as specified in the United States Car Specification PF-9600, Change A. As a result of these weaknesses, the use of thermoplastic polyester insulation has been limited in North America.

In addition to the foregoing discussion, the amount of wiring in automobiles has increased exponentially, as more electronics are being used in modern vehicles. This dramatic increase in wiring has motivated automobile manufacturers to reduce overall wire diameter by specifying thinner wall thicknesses, and specifying smaller conductor sizes. The forthcoming ISO 6722 specification (referred to as ultra-thin wire) reduces the insulation wall thickness to 0.20 mm. One automobile manufacturer in North America has released a new specification requiring a 0.15 mm wall thickness.

These reductions in insulation wall thicknesses pose manufacturing difficulties for wire fabricators. For XLPE, the thinner wall thickness of the insulation results in shorter thermal life, when aged at oven temperatures between 150° C. and 180° C. This limits their thermal rating. For example, a copper wire with an XLPE insulation having a 0.75 mm wall thickness is flexible, and does not crack when bent around a mandrel after being exposed to 150° C. for 3,000 hours. But this same copper wire, with the same XLPE insulation having a 0.25 mm wall thickness, becomes brittle after being exposed to 1500° C. for 3,000 hours.

The deleterious effects created by these extremely thin wall requirements have been attributed to copper catalyzed degradation, which is widely recognized as a problem in the industry.

XLPE insulation has many of the desired properties of the polyester materials, in addition to possessing good resistance to water. However, this material degrades when it comes into contact with copper at high temperatures.

It is possible to tin coat the copper core in order to prevent the copper from contacting the XLPE, but the additional cost of tin and the tin coating process are expensive. In addition, most automotive specifications require that the copper core be uncoated.

It is also possible to add copper stabilizers to the polyethylene compound, but copper stabilizers (such as Ciba Geigy Irganox MD-1024) yield only partial protection for wire having thin wall thicknesses, when used at 150° C.

Polyolefins are also known to undergo oxidative degradation, especially at elevated temperatures. This defect has been long known to those in the art but the solution to the problem is not easy to obtain without significantly degrading other beneficial properties of the polyolefin.

DESCRIPTION OF THE RELATED ART

Polyolefin insulated wires have been overcoated with a protective layer of fluorocarbon polymer (see U.S. Pat. No. 5,281,766 to Hildreth). This patent utilizes a fluorocarbon polymer as a protectant layer over the polyolefin insulation to protect against varnish. The varnish, which comprises a polyester or epoxy base, is applied during a bake process. If varnish is inadvertently applied to the polyolefin insulation, the insulation becomes brittle and cracks on bending. The fluorocarbon polymer disclosed in the '767 patent is polyvinylidene fluoride or a polyvinylidene co-polymer having a maximum thickness of 5mil. However, no mention is made of the problem of oxidation of the polyolefin. Neither are any data presented to teach the increased useful life of the fluorocarbon polymer protection overcoat. Furthermore, no mention is made of the need for, or benefit of, multiple insulative underlayers.

Other prior art references disclose multilayer polymeric layers disposed on a metal wire or cable. For example, see U.S. Pat. Nos. 5,326,935 and 5,362,925 to Yamaguchi et al., where a three layer polymer insulation is described for wiring within a transformer. The examples that are given are for each of the three layers to be composed of a fluorinated polymer or other high-performance polymers such as polyurethane, polyimides, polyphenylene sulfide and the like. No mention is made of polyethylene. The problem that was solved in '925 and '935 reference related to thermal, not chemical, decomposition.

U.S. Pat. No. 5,462,803 , to Wessels, describes the use fluorocarbon polymers as an inner layer in a wire insulation. The outer layer is composed of polyvinyl chloride and the design is used to prepare fire-resistant plenum cable. Wessels states that fluoro-containing polymers, while being excellent insulators, are expensive. Thus, it is preferable that the thickness of the inner layer be kept to a minimum. No mention is made of unhalogenated polyolefins as is present in the current invention.

Other references relating to multilayered polymeric coating of metallic articles include U.S. Pat. No. 4,801,501 to Harlow, U.S. Pat. No. 4,988,835 to Shah, U.S. Pat. No. 5,059,483 to Lunk et al., U.S. Pat. No. 5,426,264 to Livingston et al., U.S. Pat. No. 4,521,485 to Tondre et al., U.S. Pat. No. 5,371,325 to Kalola et al., U.S. Pat. No. 5,841,072 to Gagnon, and U.S. Pat. No. 5,358,786 and U.S. Pat. No. 5,521,009 to Ishikawa et al.

However, none of the above references, either alone or in combination, teach or suggest either the composition of the present invention or a means of increasing the useful life of an olefinic polymer such as polyethylene in an insulative structure by simultaneously mitigating both the copper and aerial degradation pathways through the use of a ternary or tri-layer polymeric design. In virtually all cases these patents are directed toward solving problems regarding flammability, flexibility, or physical toughness. To solve such problems, the prior art patentees have looked towards combinations of polymeric components that are costly, overlooking the possibility of using less expensive materials such as polyethylene.

SUMMARY OF THE INVENTION

The present invention reflects the discovery that desired performance of polyolefinic insulation can be achieved by utilizing an integrated composite of insulation layers, rather than a single layer. The composite comprises a first, inner layer of a fluorocarbon polymer or other polymer having resistance to metal catalyzed degradation; a second, intermediary layer comprising polyolefin polymers; and a third, outer layer of a fluorinated polymer that is resistant to oxidation. The outer layer is designed to be chemically resistant to automotive fluids and salt water, as well as to high temperatures. The outer layer is also designed to provide the required mechanical protection. This composite insulation makes the wire suitable for under-the-hood automotive applications.

Other polymers that can be used as a first, inner layer to prevent copper migration into the XLPE include such high temperature polymers selected from a group consisting of: polyether sulfone, poly-ether-ketone, polyetherimide, and thermoplastic polyester. These polymers can be used in place of the first, inner fluorocarbon polymer. In another embodiment of the invention, optional adhesive layers are provided which can be incorporated into the insulative structure between any of the three polymer layers.

The insulation for metal articles of the present invention provides a beneficial combination of physical and electrical properties. The outer layer provides excellent resistance to physical abuse. The inner layer is preferably more flexible than the subsequently coated layers and thus provides insulation which can be physically tough yet flexible.

In accordance with the present invention, there is provided a high-temperature, automotive-wire article having a thin wall construction and an operative temperature that is greater than 135° C. The wire article comprises an inner core of metal that is surrounded by a polymer insulation, the latter including an integral composite of three layers. The first, inner layer of the composite comprises a polymeric material that is insensitive to copper catalyzed degradation, while the second, intermediate layer of the composite comprises a polyolefin material that is preferably crosslinked by irradiation. Irradiation cross-linking requires a dose of approximately 60 to 400 kGy, and preferably between 100 and 200 kGy. The third, outer layer of the insulative tri-pack is a fluorinated polymer having excellent physical toughness and chemical inertness. It is specifically selected to limit the oxidation of the underlying polyolefin layer.

The XLPE intermediary layer can be chemically cross-linked or can be cross-linked by irradiation processing. The irradiation process of cross-linking the polyethylene suggests that certain fluorocarbon homopolymers made from monomers such tetrafluoroethylene and hexafluoropropylene should preferably not be used as the first, inner polymer unless irradiation is not required. This is because their properties are adversely affected by irradiation. However, fluorocarbon copolymers, such as ethylene-tetrafluoroethylene, can be irradiation cross-linked with a reactive monomer, such as triallyl isocyanurate, which increases the high temperature capability.

The inner, intermediary, and outer layers can either be bonded together with the use of an adhesive, or thermally fused together to form an integral insulation. Furthermore, this integral insulation can readily be removed from the conductor with commercially available equipment. The total wall thickness of the composite is generally less than 0.5 mm, and usually between approximately 0.15 mm. and 0.41 mm. When the first, inner layer is composed of a fluorocarbon polymer it is preferably made of a fluorocarbon polymer that contains $CH_2$ groups as part of the polymer chain. Methylene groups within the backbone are necessary to create crosslinks during the optional irradiation process. The inner layer has a thickness in the range of between approximately 0.025 mm and 0.13 mm, and preferably less than 0.05 mm.

BRIEF DESCRIPTION OF THE DRAWINGS

A complete understanding of the present invention may be obtained by reference to the accompanying drawings, when considered in conjunction with the subsequent detailed description, in which the figures illustrate a perspective view of the high-temperature, automotive-wire article of this invention.

DESCRIPTION OF THE PREFERRED EMBODIMENT

The term "cable" is used herein to include a single electrically insulated elongate conductor (often referred to in the art as "wire"), an article comprising a plurality of separate elongate conductors each of which is separately insulated, and an article comprising a plurality of elongate conductors which are physically joined together but electrically insulated from each other by insulating material (e.g. ribbon cable).

Generally speaking, the invention features a high-temperature, automotive-wire article formed of three insulation layers disposed over a copper wire core. The three insulation layers form a single integral layer. In order to meet automotive industry requirements, this composite insulation has a total wall thickness of less than approximately 0.5 mm.

Figure 1A:
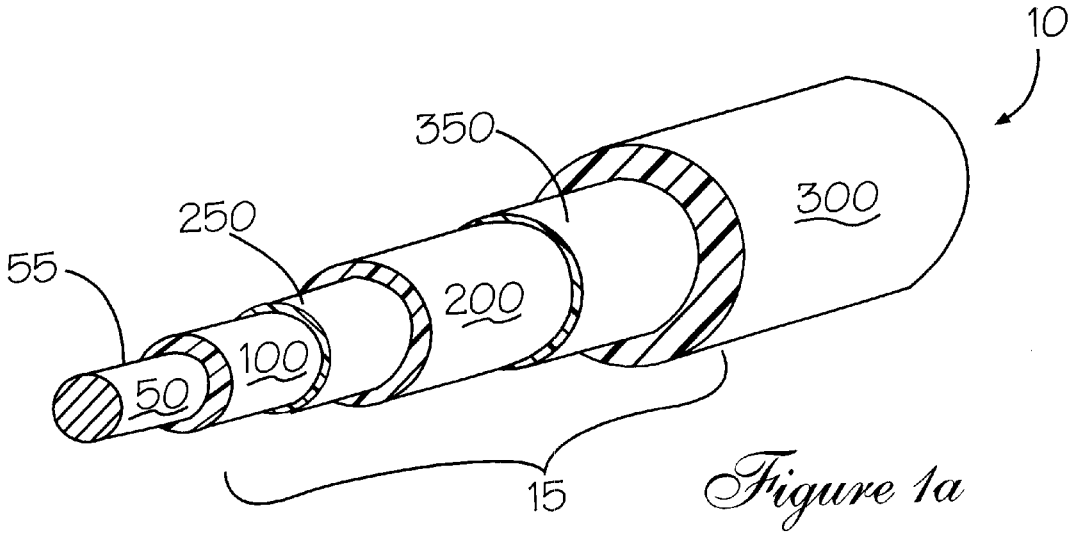
FIGS. 1*a* & 1*b* disclose a high temperature wire article.
Figure 1B:
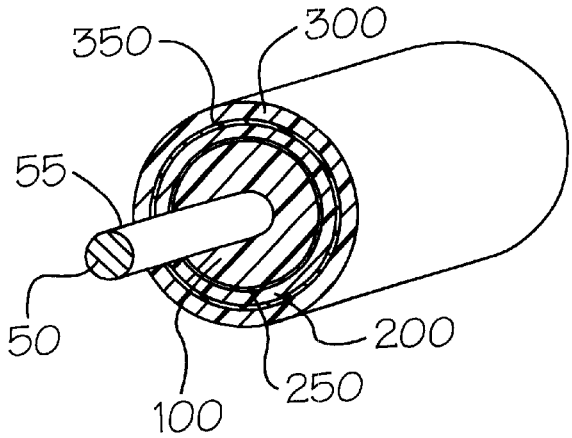
Figure 1C:
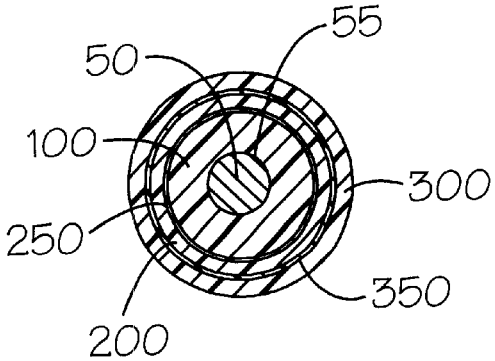
FIG. 1*c* discloses a cross section of the high temperature wire disclosed in FIGS. 1*a* & 1*b;*

Referring to FIGS. 1*a*, 1*b*, and 1*c*, a high-temperature wire article 10 of this invention is illustrated in various view. The automotive-wire article 10 typically includes an electrically conductive core 50 of bare copper strands or solid copper wire. The core 50 is covered on its exposed surface 55 with a composite of insulation layers 15. This composite insulation comprises a first, inner layer 100, a second, intermediary layer 200, and a third, outer layer 300. The first, second, and third layers 100, 200, and 300, respectively, can optionally be bonded together by high-temperature adhesive layers 250 and 350. The integration of the first, second, and third polymer layers 100, 200, and 300, respectively, allows all layers to act as a single layer. Therefore, when the wire article 10 is bent around terminals (not shown), the insulation does not wrinkle. Adhesive layers 250 and 350 also serve to obtain a satisfactory bond so that all polymer layers can readily be removed from the conductor 50.

Figure 2:
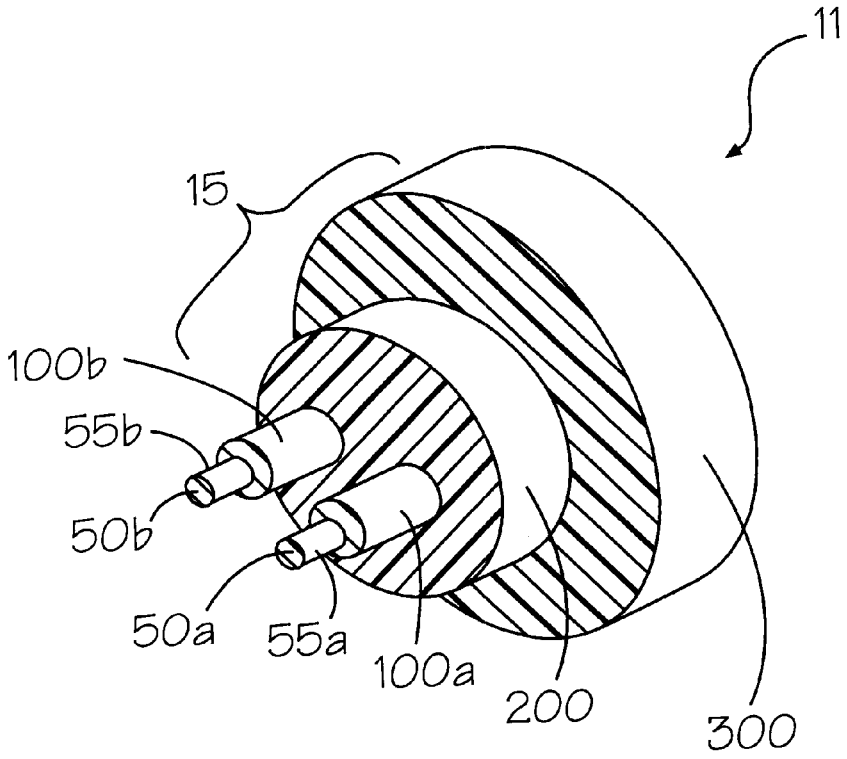
FIG. 2 discloses an alternative embodiment of the high temperature wire article.

FIG. 2 depicts an embodiment wherein two conductive wires, 50*a* and 50*b*, are insulated within an article 11. In this embodiment each conductive wire, 50*a* and 50*b*, is itself covered on its respective exposed surface 55*a* and with 55*b* a first insulative polymer layer, 100*a* and 100*b*, respectively. A second insulation layer, 200, then uniformly covers the individual first insulative layers 100*a* and 100*b*. Finally, a third insulative layer 300 covers the second insulative layer 200.

Figure 3:
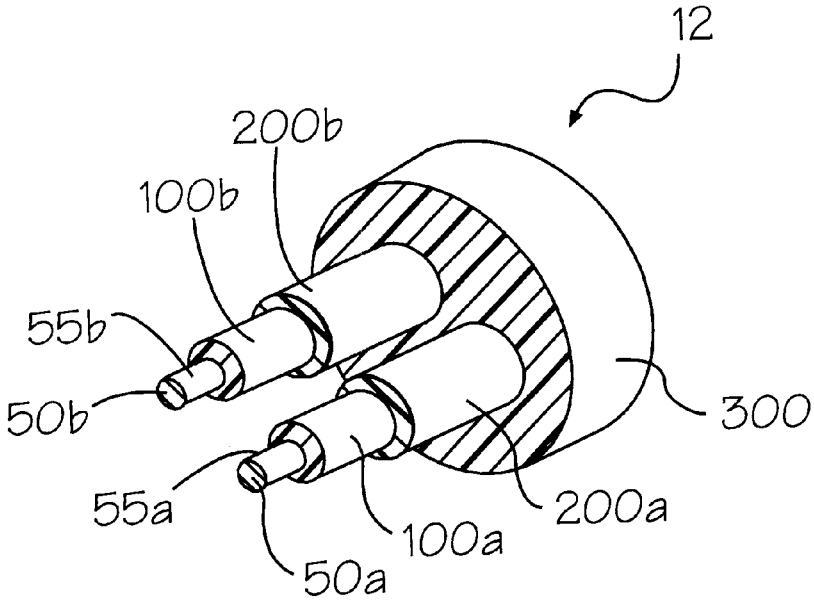
FIG. 3 discloses another alternative embodiment of the high temperature wire article.

FIG. 3 depicts an embodiment wherein two conductive wires, 50*a* and 50*b* are insulated within an article 12. Each wire 50*a* and 50*b* is individually covered on its exposed surface 55*a* and 55*b* with first and second insulation layers. For example, conductor 50*a* is covered with first insulator 100*a* and subsequently second insulator 200*a*, while conductor 50*b* is covered with first insulator 100*b* and subsequently second insulator 200*b*. Both insulated conductive wires are then covered in third insulative layer 300.

Figure 4:
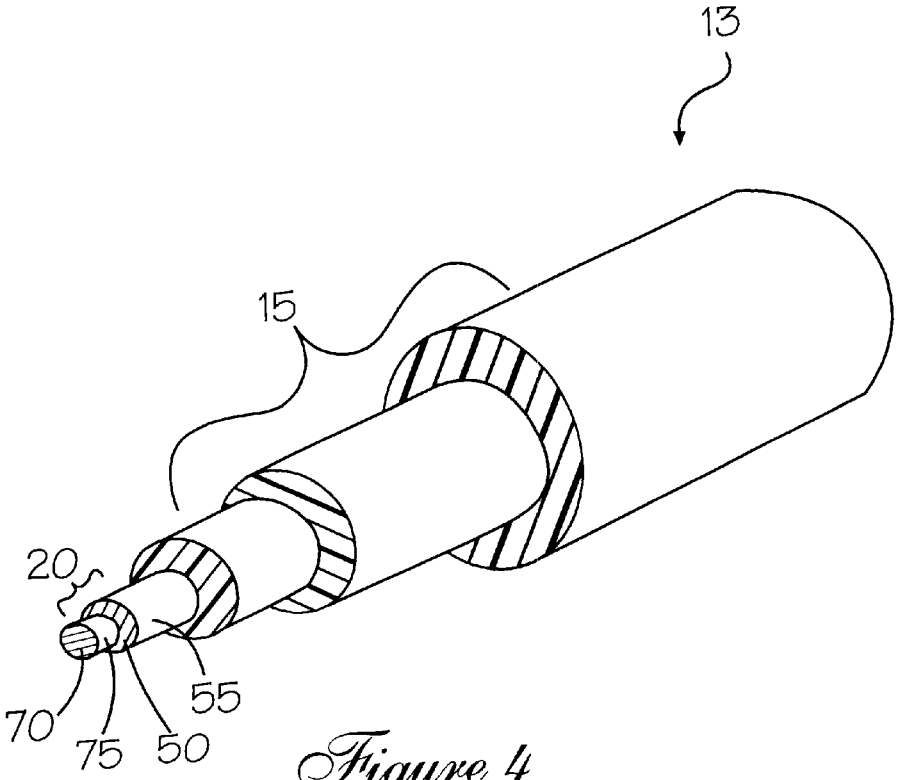
FIG. 4 discloses an alternative embodiment of the high temperature wire article.

FIG. 4 depicts yet another embodiment 13 of the invention wherein the conductive wire is a metallic core-shell member 20. The metallic core 50and the metallic shell 70 may or may not be of the same metal. Metallic core-shell member 20 is covered on its exposed surface 75 with a composite of insulation layers. This composite insulation comprises a first, inner layer 100, a second, intermediary layer 200, and a third, outer layer 300.

Figure 5:
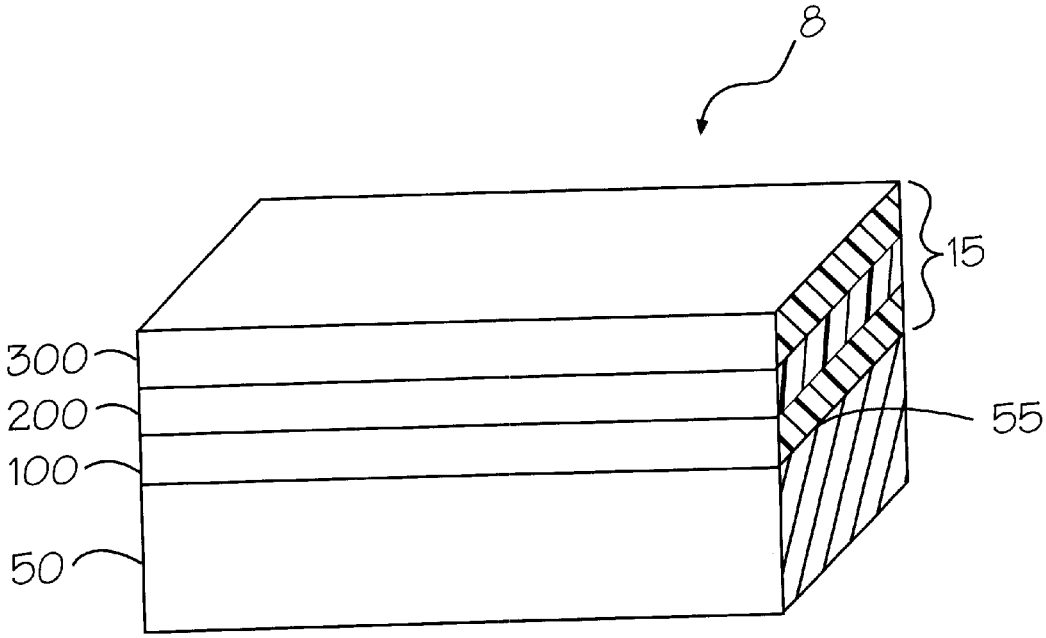
FIG. 5 discloses an alternative flat embodiment of the high temperature wire article.

FIG. 5 depicts still another embodiment 8 wherein the metal article 50 comprises at least one flat outer exposed peripherial surface 55 that is covered by a composite 15 of polymeric layers. This composite insulation comprises a first, inner layer 100, a second, intermediary layer 200, and a third, outer layer 300.

Figure 6:
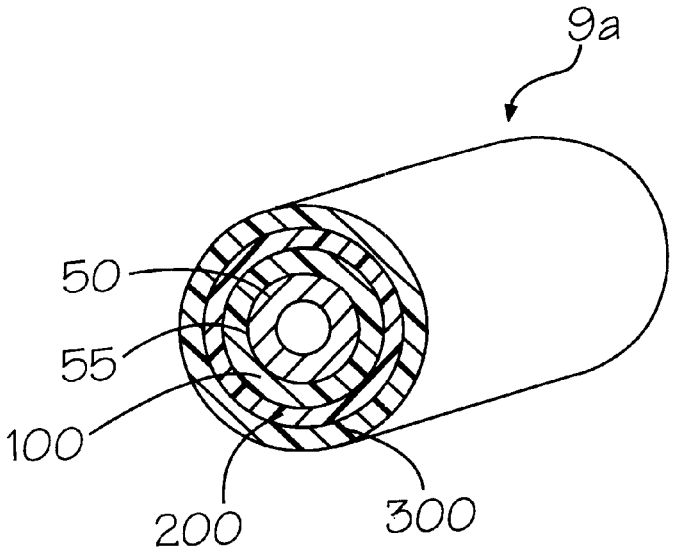
FIG. 6 discloses an alternative embodiment of the high temperature wire article.

FIG. 6 depicts still another embodiment 9*a* wherein the article comprises a metal tube 50 whose outer exposed surface 55 is covered by a composite of polymeric layers. This composite insulation comprises a first, inner layer 100, a second, intermediary layer 200, and a third, outer layer 300.

Figure 7:
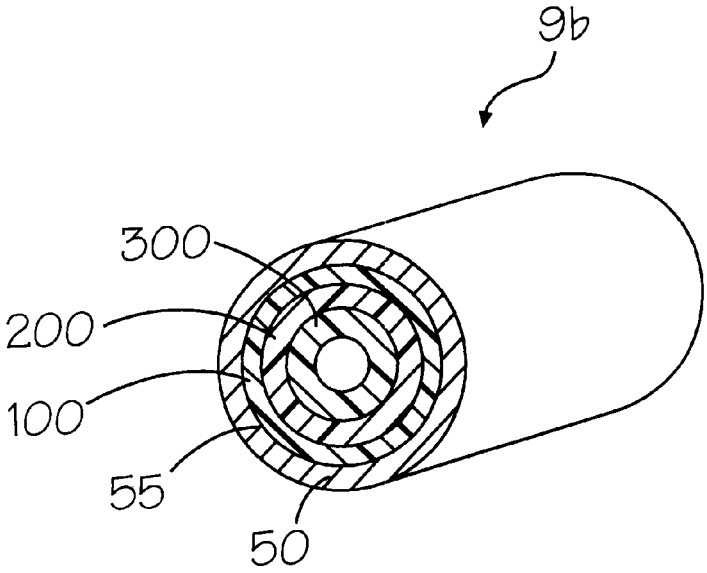
FIG. 7 discloses an alternative embodiment of the high temperature wire article.

FIG. 7 depicts still another embodiment 9*b* wherein the article comprises a metal tube 50 whose inner exposed surface 55 is covered by a composite of polymeric layers. This composite insulation comprises a first, inner layer 100, a second, intermediary layer 200, and a third, outer layer 300.

The metal core of the present invention can be composed of any of the known metals and their alloys. Such metals can be found in the periodic chart in Groups VIIIA, IB, IIB, IIIB, and IVB. To avoid confusion with different nomenclature of Groups, the first row of Group VIIIA comprises iron, cobalt and nickel; the first row element of Group IB is copper; the first row element of Group IIB is zinc, and so forth. Of specific interest is aluminum, copper, steel, and silver. The core can also contain more than one layer. For instance, it is common to apply a protective metal coating to certain metals that tend to oxidize, this orientation is depicted in FIG. 4. For example, nickel, silver, tin or zinc plating is commonly applied to metals such as iron or copper. The most preferred core metal is copper or its alloys. The copper can be either annealed or unannealed depending on the final application. The copper may further be associated with a solder composition.

It is also contemplated that the core can be in the or form of a number of common shapes such as ingots, hollow tubes, wires, thin strands. These objects can be singular or in a plurality within the polymeric matrix discussed hereinbelow. Especially for elongated electroconductive articles such as wires or cable, it is envisioned that each of the metal core will be either a single, solid element or a plurality of thin strands. Typically, the articles of this invention can be used in low, mid or high voltage conditions but usually the gauge of the cable or wire will be between about 26–0000. Other uses of the present invention include but are not limited to building wire, aircraft wire, plenum wiring for local area network computers and communication, transformer wiring for isolating magnetic and electrical wiring, underground wiring, electrical conductive wiring for automotive and general electrical machinery, and tubing or piping.

The typical insulation composite 15 of the automotive wire articles 10, 11, 12, and 13 of this invention has a total thickness of from 0.2 mm to about 0.5 mm and an operative temperature range of between approximately 135° C. and 180° C. Although it is required that three polymeric layers comprise the coating of the metallic core, it is within the scope of this invention to coat multiple individual metal cores with several configurations of insulation. These are depicted in FIGS. 2 and 3.

In one embodiment the first, inner layer 100 comprises a fluorocarbon polymer. In other embodiments the inner layer is selected from a group of materials consisting of polyether sulfone, polyether-ketone, polyetherimide, thermoplastic polyesters, and mixtures thereof.

The inner polymer layer 100 may be in contact with an inner or outer exposed metal surface 55 or substantially surround the electrical conductor 50 depending on the configuration of the core and the articles ultimate use.

The term "fluorocarbon containing polymer" is used herein to denote a polymer or mixture of polymers which contains more than 10%, preferably more than 25%, by weight of fluorine. Thus, the fluorocarbon polymer may be a mixture of two or more fluorine-containing polymers, or a mixture of one or more fluorine-containing polymers with one or more polymers which do not contain fluorine. Preferably, the fluorocarbon polymer comprises at least 50% by weight, and preferably at least 75%, especially at least 85%, by weight of one or more thermoplastic crystalline polymers each containing at least 25% by weight of fluorine. The fluorocarbon containing polymers are generally homo-, copolymers, terpolymers or more complex mixtures of one or more fluorine-containing olefinically unsaturated monomers, or copolymers of one or more such monomers with one or more olefins. Preferred polymers are perfluorinated. The fluorocarbon polymer has a melting point of at least 150° C., and will often have a melting point of at least 200° C., e.g. up to 300° C. Preferably the polymeric composition has a viscosity of less than $10^5$ poise at a temperature not more than 60° C. above its melting point.

The fluorinated polymer in the first polymer layer 100 closest to the metal core 50 may be either a homopolymer, a co-polymer or a terpolymer. For the case of the co-polymer or terpolymer, the incorporated monomers may either be in random, alternating, block, or graft juxtaposition. The fluorinated polymers in this invention may be either isotactic, syntactic or atactic. A preferred fluorinated polymer has at least one methylene group within the backbone of said second fluorinated polyolefin. The fluorinated polymer may be either in a discrete uniform layer without voids or may be in a foam or cellular form.

Preferred classes of fluorinated polymers are homo-, co-, and terpolymers derived from vinylidene fluoride (VDF). Other monomers suitable for copolymerization with vinylidene fluoride include at least one of ethylene, tetrafluoroethylene, hexafluoropropylene, or with hexafluoroisobutylene or mixtures thereof. Polymers derived from ethylene and tetrafluoroethylene (TFE), hexafluoropropylene (HFP), hexafluoroisobutylene or mixtures thereof are useful since they also possess methylene groups within the backbone should crosslinking be performed.

Another preferred fluorocarbon polymer is a copolymer of ethylene and tetrafluoroethylene and optionally one or more other comonomers, especially a copolymer comprising 35 to 60 mole percent of ethylene, 35 to 60 mole percent of tetrafluoroethylene and up to 10 mole percent of one or more other comonomers. Other preferred polymers are a ethylene-chlorotrifluoroethylene (ECTFE), and an ethylene-tetrafluoroethylene (ETFE) resin. If the coated metal article is not subjected to irradiation then polytetrafluoroethylene (PTFE) or a fluorinated ethylenepropylene resin are also acceptable fluorocarbon copolymers.

Exemplary fluorinated polymers which can be used include copolymers of ethylene and chlorotrifluoroethylene (commercially available under the trade name HALAR® from Ausimont Chemical Co.); a co-polymer of ethylene and tetrafluoroethylene under the tradename TEFZEL® from Du Pont; a fluoro terpolymer of TFE, VDF, and HFP under the tradename DYNEON THV 200® from Dyneon (a 3M/Hoechst enterprise); a polymer of vinylidene fluoride under the tradename of KYNAR® supplied by Pennwalt.

Exemplary aromatic, non-fluorinated polymers useful in the first polymeric layer include Ultem®, a polyetherimide available from General Electric; Victrex® 200P, a polyethersulphone available from ICI; and PEEK®, a polyether ether ketone available from ICI.

When, as is preferred, the polymeric composition is electrically insulating, any conductive fillers which are present should be used in small amounts which do not render the composition conductive. The fluorocarbon polymer is extruded or coated over the electrical conductor by conventional wire covering equipment and techniques. The inner layer is between about 0.05 mm and about 1.0 mm thick, preferable thicknesses range from 0.05 mm to about 0.5 mm. Most preferably the thickness is 0.05 mm to about 0.1 mm.

Of critical importance is that the polymer chosen for the first, inner polymer layer 100 be resistant to copper catalyzed degradation and that it possess acceptable insulating properties.

The second, intermediary layer 200 comprises a crosslinked polyolefin, insulation, preferably an irradiated, cross-linked polyethylene (XLPE) that has been irradiated with between approximately 60 to 400 kGy, and preferably between 100 and 200 kGy. The polyolefin can be selected from a group consisting of polyethylene, co-polymers, terpolymer of polyethylene, or blends of different polyethylenes or polyolefins. Either high density or low density polyethylene is useful within this invention. For the case of the co-polymer or terpolymer the incorporated monomers may either be in random, alternating, block, or graft juxtaposition. The polyolefin polymers in this invention may be either isotactic, syntactic or atactic. One preferred polymer composition is ethylene/propylene/diene copolymer (EPDM). Particularly preferred polyolefins are derived from the metallocene process. These co-polymers are prepared using Group IVB catalysts (e.g., titanium, zirconium or hafnium compounds) and are especially randomized in the juxtaposition of the monomers.

Other functionalized monomers that can be included as part of the polyolefin include acrylate and methacrylate esters such as methyl acrylate, ethyl acrylate, and butyl acrylate; ionomers such as acrylic acid and methacrylic acid and metal salts thereof; and olefinic esters of low molecular weight carboxylic acids such as vinyl acetate. A particularly preferred ionomer is a ethylene/methacrylic acid copolymer in which the methacrylic acid carboxylic acid functionalities have been partially neutralized with zinc ions commercially available from DuPont under the trade name SURLYN®. The amount of the functionalized monomers within the polyolefin is not critical within the scope of the present invention but values below 50 mole % are preferred.

The second, intermediary layer has a thickness in the range of between approximately 0.025 mm and 0.40 mm, preferably less than 0.03 mm.

The third, outer layer requires a fluorocarbon polymeric composition. It is preferred that the polymeric composition be at least 25 wt % of a fluorinated polymer. The fluorocarbon polymeric composition can itself be composed of one or more fluorocarbon polymers. The selection of polymers suitable for this invention are embodied in the list of fluorinated polymers described for incorporation into the first, inner layer 100. Unlike the inner layer fluoropolymers, the outer layer fluoropolymers are required to be physically tough and resilient. For this reason the outer layer fluorinated polymers are preferentially selected based on this property and less so upon their ability to crosslink. Therefore, polymers based on tetrafluoroethylene are a preferred choice. Other fluorinated polymers, especially those that are crosslinkable, are acceptable should this process be preferred.

The third, outer layer 300 has a thickness less than approximately 0.02 mm to about 0.50 mm. Preferably the thickness of the third layer is between 0.05 mm and 0.15 mm.

The polymeric layers of the present invention can be applied by any of the known techniques such as dipping, spraying, cascade coating, extruding, depositing, and tape wrapping. Most preferable is extrusion coating, especially where wire metal cores are being coated because of the close control of dimension and concentricity. The individual layers may be applied simultaneously from a single die or may be separately applied in several passes or die stations. This latter process allows the possibility of crosslinking at intermediate stages so that only certain layers are crosslinked by exposure to irradiation. Specific layers can also be chemically crosslinked by adding crosslinking additives to only selected layers.

Means of crosslinkage may be arbitrarily selected from standard techniques as chemical or radiation initiation, but crosslinking by radiation curing is preferable. Chemical crosslinking can be initiated by any of the well known initiators such as peroxides or silanes and further can be thermally modulated. When the crosslinking process is induced with high energy radiation, typically electron beam or gamma radiation is employed to initiate the crosslinking process. Radiation rates from about 50 to about 500 kGy are useful, but 100 to 200 kGy are preferred. It is preferred not to form an excessive number of crosslinking sites, as this embrittles the polymer matrix and causes cracking if the polymer matrix is bent. Control of crosslinking is dependent on the amount of crosslinking agent and the radiation dose. The crosslinking agent is preferably a material that generates or reacts with radical species. The radicals productively formed are on the backbone of the fluorinated polymer or olefinic polymer. These species then can react with added crosslinking agents to generate three-dimensional matrices. Depending on the extent of crosslinking, the polymeric materials can be converted from thermoplastic to thermosetting materials.

This radical-generating or crosslinking component is activated by high energy, typically electron beam radiation. The radical-generating component assists in crosslinking the elastomer. Useful radical-generating agents contain at least one allyl or vinyl group selected from the group of esters of methacrylic acid, polyfunctional vinyl monomers and mixtures thereof. Particularly preferred are compounds that contain two, three or four vinyl or allyl groups per molecule. Specific materials include triallyl isocyanurate, triallylcyanurate, trimethylpropane trimethacrylate, decamethylene glycol dimethacrylate, triallyl trimellitate, triallyl trimesate, tetraallyl pyromellitate, ethoxylated bis phenol α-trimethacrylate, divinylbenzene, diallylphthalate, diallyl maleate, pentaerythritol triacrylate, trimethylolpropane triacrylate, trimethylolpropane trimethacrylate, or mixtures thereof.

A preferred radical-generating compound is triallylisocyanurate (TAIC) supplied by Nippon Kasei Ltd. When TAIC is irradiated, it forms reactive species that abstract hydrogen atoms from labile sites on the elastomer. Typically, these labile sites are secondary or tertiary sites on the elastomer backbone adjacent to functionalities that can stabilize the radical formation by conjugation. The so formed radical then can combine with another radical either on the same backbone or another backbone to generate, respectively, intramolecular or intermolecular crosslinks.

Another possible crosslink mechanism is through a hydrogen transfer from the labile hydrogens discussed supra to a first allyl group in the TAIC molecule followed by bond formation. When this process is repeated on a second allyl group, a crosslink incorporating the TAIC is created. It is conceivable that this latter process can also continue to create a third crosslink through the original TAIC molecule. Whether or not the TAIC is incorporated into the crosslink, the density of the crosslinks is dependent on the amount of radical-generating compound and on the intensity and time of electron beam irradiation. Typically 1–5 parts by weight of crosslinker are used per 100 parts block co-polymer.

Other additives can be beneficially added to one or more layers of the polymeric coating. The polymeric compositions can optionally contain suitable additives such as pigments, antioxidants, thermal stabilizers, acid acceptors and processing aids, and fire retardants such as decabromophenyl ether or 1,2-bis-(tetrabromophthalamido)-ethylene. An example of a useful hindered phenol which acts as an antioxidant and heat stabilizing agent is tetrakis-[methane-3-(3',51'-di-tert-butyl-4-hydroxyphenol)-propionate] methane. For example, 0.1 to 5 parts by weight of a hindered phenol base antioxidant as against 100 parts by weight of the olefinic polymer constituting the intermediate layer 200 may be added.

Metal oxides such as antimony oxide, titanium oxide, or zinc oxide can be added to the first and/or the third polymer layers. These oxides serve as a pigment and provide is an optical opacity so that if the polymer layer must be removed or stripped from the metallic core, it is easy to observe.

Metal salts of 2-alkylmercaptobenzimidazole can be beneficially added to the polyolefinic second layer. A preferred metal salt is zinc and preferred alkyl groups contain from 1 to about 5 carbons. The benzimidazole moiety can be further substituted on the ring with functionalities such as alkyl, halo, and nitrilo groups. These materials when used with a phenolic antioxidant provide oxygen resistance to the polyolefin and are used in the amounts of about 1% to about 12%.

As discussed hereinabove, optional adhesion layers 250 and 350 can be employed between any or all of the adjacent polymeric layers. Useful formulations are low molecular weight acrylates. Typically the thickness of the adhesive layer is approximately 0.002 to about 0.1 mm. A preferred thickness is approximately 0.00 mm. The adhesion promoting layers assist in making the tri-layer insulation package into an integral article. This aids in preventing kinks forming when bending and makes it easier to completely remove or strip the insulation package from the metal core. A typical adhesion layer composition comprises an ethylene/vinyl acetate co-polymer marketed by Du Pont under the tradename ELVAX® 46L.

EXAMPLE 1: (Comparative)

The wire article 10 comprises a conductive core 50 with a cross sectional area of 0.5 $mm^2$ (seven strands of 0.08 $mm^2$) bare copper that is surrounded by a composite insulation having two insulative layers, including an inner layer 100 and an outer layer 200. The inner layer 100 is a terpolymer composed of tetrafluoroethylene, hexafluoropropylene and vinylidene fluoride which is commercially available from Dyneon LLC in Oakdale, Minn. under the tradename Dyneon® THV 200G and further contains 5 parts TAIC, 0.5 parts Irganox® 1010, and 3 parts antimony oxide per 100 parts Dyneon THV 200G. The thickness of the inner layer 100 is 0.050 mm, which is extruded onto the wire core using standard tube extrusion techniques readily known in the industry. The second layer, extruded over the first insulating layer is 0.25 mm thick and comprises a cross-linked polyethylene (XLPE) that has been electron beam irradiated with approximately 150 kGy.

The wire article 10 has a typical operating temperature of between 135° C. and 180° C. A comparison of the high temperature properties of the above wire with a fluorocarbon jacketted wire of the same type (see Example 2) is shown below in Table I.

EXAMPLE 2: (invention)

The wire as described in Example 1 is further coated with a third, outer insulative layer comprising a polymeric composition containing a co-polymer of ethylene and chlorotrifluoroethylene (ECTE) marketed by Ausimont USA Inc under the tradename HALAR®. This third layer has a 0.15 mm radial thickness. The critical test performed on Example 1 and 2 coated wires is described in ISO 6722-1 1996 sections 10.2 and 10.3.1 and is shown in Table I as "Days to 50% failure at 180° C.".

TABLE I

| Example No. | 1 | 2 |
|---|---|---|
| Inner layer[1] Wall Thickness | 0.002 in. | 0.002 in. |
| Middle Layer[2] Wall Thickness | 0.010 in. | 0.009 in. |
| Jacket or Outer[3] Layer Wall Thickness | none | 0.006 in. |
| Days to 50% failure at 180° C.[4] | 18/19 days | 31 days |

[1]-100 parts Dyneon THV 200 F with 5 parts TAIC, 0.5 parts Irganox 1010 and 3 parts antimony oxide
[2]-Irradiation cross-linked polyolefin
[3]-Halar ECTFE
[4]-Tested to procedures of ISO 6722-1 1996 sec. 10.2 and 10.3.1

To further illustrate the benefit of the current invention Examples 3 to 7 are provided where one or more of the insulative layers are removed. As will be noted there is a substantial increase in the "Days to 50% failure at 180° C." when the entire inventive design comprising three insulative layers are employed compared to any of the comparative examples. This increase in lifetime is unexpected since no reported studies have been performed on the interaction of the degradative mechanisms of polyethylene by metal catalysis and oxidation.

EXAMPLE 3: (Comparison)

The wire article 10 comprises a conductive core 50 with a diameter of 0.95 mm bare copper that is surrounded by a composite insulation having insulative layer 200 extruded over the metal core. The insulative layer is 0.40 mm thick and comprises a cross-linked polyethylene (XLPE) that has been electron beam irradiated with approximately 150 kGy.

EXAMPLE 4 (Comparative)

The wire article 10 comprises a conductive core 50 with a diameter of 0.95 mm bare copper that is surrounded by a composite insulation having two insulative layers, including an inner layer 100 and an outer layer 200. The inner layer 100 is a terpolymer composed of tetrafluoroethylene, hexafluoropropylene and vinylidene fluoride which is commercially available from Dyneon LLC in Oakdale, Minn. under the tradename Dyneon® THV 200G and further contains 5 parts TAIC, 0.5 parts Irganox® 1010, and 3 parts antimony oxide per 100 parts Dyneon® THV 200G. The thickness of the inner layer 100 is 0.050 mm, which is extruded onto the wire core using standard tube extrusion techniques readily known in the industry. The second layer, extruded over the first insulating layer is 0.35 mm thick and comprises a cross-linked polyethylene (XLPE) that has been electron beam irradiated with approximately 150 kGy.

EXAMPLE 5 (Invention)

The coated wire from Example 4 is further coated with a third, outer insulative layer of ethylene chlorotrifluoroethylene copolymer having a radial thickness of 0.075 mm.

EXAMPLE 6 (Invention)

The coated wire from Example 5 wherein the third, outer layer is subjected to electron beam irradiation of approximately 150 kGy.

EXAMPLE 7 (Invention)

The coated wire of Example 4 further coated with a third, outer insulative layer 300 of polyvinylidene fluoride having a radial thickness of 0.100 mm. Wherein the third, outer layer is subjected to electron beam irradiation of approximately 150 kGy.

TABLE II

| Example | 3 | 4 | 5 | 6 | 7 |
|---|---|---|---|---|---|
| Conductor Diameter (inches) | 0.038 | 0.038 | 0.0395 | 0.0395 | 0.0395 |
| Inner Layer[1] Wall Thickness (inches) | None | 0.002 | 0.0014 | 0.0013 | 0.0016 |
| Middle Layer[2] Wall Thickness (inches) | 0.016 | 0.0014 | 0.012 | 0.012 | 0.012 |
| Jacket or Outer Layer Type | None | None | ECTFE[3] | cross-linked ECTFE[4] | cross-linked PVDF[5] |
| Jacket or Outer Layer Wall Thickness | N/A | N/A | 0.003 | 0.003 | 0.004 |
| Days to 50% Failure at 180° C.[4] | 17–18 | 21–26 | 28 | 34 | 34 |

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent presented in the subsequently appended claims.

What is claimed is:

1. A composite article for use in harsh, automotive, under-the-hood environments, comprising at least one metal core having an exposed surface, a first polymeric layer comprising a fluorocarbon polymeric material disposed on said exposed surface, a second polymeric layer comprising a polyolefin disposed on said first polymeric layer, and a third polymeric layer comprising a first fluorinated polyolefin disposed on said second polymeric layer, and wherein at least one layer selected from said first polymeric, said second polymeric, and said third polymeric layers is oxidation resistant.

2. The composite article recited in claim 1, said metal core comprising metals selected from the group of elements consisting of Group VIIIA, IB, IIB, IIIB, IVB, and combinations thereof of the periodic table of elements.

3. The composite article recited in claim 2, wherein said elements comprise copper and its alloys selected from said Group VIIIA, IB, IIB, IIIB, and IVB of the periodic table of elements.

4. The composite article recited in claim 3, wherein said copper is soft annealed copper.

5. The composite article recited in claim 3, wherein said copper is hard unannealed copper.

6. The composite article recited in claim 1, said at least one metal core having a form selected from the group consisting of an ingot, a sheet, a hollow tube, a solid wire, multiple individual wires, and multiple associated strands.

7. The composite article recited in claim 6, said first, second and third polymer layers form concentric layers around said exposed surface of said solid wire.

8. The composite article recited in claim 6, wherein said multiple individual wires are individually coated with said first polymer layer, a plurality of coated said individual wires being separately disposed within said second polymer layer and said third polymer layer covering said second polymer layer.

9. The composite article recited in claim 6, wherein said individual wires are individually coated with said first polymer and said second polymer layers, wherein coated said individual wires are separately disposed within said third polymer layer.

10. The composite article recited in claim 6, wherein said at least one metal core is in the form of said ingot and said exposed surface is essentially flat.

11. The composite article recited in claim 6, wherein said at least one metal core is in the form of a sheet and said exposed surface is essentially flat.

12. The composite article recited in claim 6, wherein said at least one metal core is in the form of a hollow tube and said exposed surface is an inner surface of said tube.

13. The composite article recited in claim 6, wherein said at least one metal core is in the form of a hollow tube and said exposed surface is an outer surface of said tube.

14. The composite article recited in claim 1, wherein said at least one metal core comprising a first metal member and a second metal member affixed to said first metal member, said second metal member separating said first metal member from said first polymeric layer.

15. The composite article recited in claim 14, said first metal member comprising a wire structure and said second metal member concentrically disposed on said first metal member.

16. The composite article recited in claim 15, comprising copper or its alloys from said Group VIIIA, IB, IIB, IIIB, and IVB of the periodic table of elements in at least one of said first metal member or second metal member.

17. The composite article recited in claim 1, wherein said fluorocarbon polymeric material is selected from a group consisting of: polyether sulfone, polyether-ketone, polyetherimide thermoplastic polyester, a second fluorinated polyolefin, and mixtures thereof.

18. The composite article recited in claim 17, said second fluorinated polyolefin comprising at least one methylene group within the backbone of said second fluorinated polyolefin.

19. The composite article recited in claim 17, wherein said second fluorinated polyolefin is derived from ethylene and at least one of vinylidene fluoride, trifluoroethylene, tetrafluoroethylene and hexafluoropropylene monomer.

20. The composite article recited in claim 17, wherein said second fluorinated polyolefin comprises homopolymers, copolymers and terpolymers derived from vinylidene difluoride monomer.

21. The composite article recited in claim 20, wherein said copolymers and terpolymers are further derived from at least one of tetrafluoroethylene and hexafluoropropylene monomers.

22. The composite article recited in claim 1, wherein said polyolefin comprises high density polyethylene, metallocene-catalyzed polyolefins, polyethylene co-polymers, and mixtures thereof.

23. The composite article recited in claim 22, wherein said polyethylene co-polymers comprise vinyl acetate, methyl acrylate, ethyl acrylate, butyl acrylate and metal salts of methacrylic acid.

24. The composite article recited in claim 1, wherein said first fluorinated polyolefin is selected from the group consisting of a copolymer of ethylene and chlorotrifluoroethylene; a copolymer comprising hexafluoropropylene, a homopolymer of vinylidene difluoride; a copolymer of ethylene and tetrafluoroethylene; a homopolymer of tetrafluoroethylene; and a terpolymer of tetrafluoroethylene, vinylidene fluoride and hexafluoropropylene.

25. The composite article recited in claim 24, wherein said first fluorinated polyolefin is intermolecularly crosslinked.

26. The composite article recited in claim 1, wherein at least one of said fluorocarbon polymeric material, said polyolefin and said first fluorinated polyolefin are intermolecularly crosslinked within said first, second, and third layer respectively.

27. The composite article recited in claim 26, wherein said intermolecular crosslinking is achieved by electron beam irradiation.

28. The composite article recited in claim 27, wherein said electron beam irradiation is performed at about 50 to 500 kGy.

29. The composite article recited in claim 27, wherein said electron beam irradiation is performed at about 100 to 200 kGy.

30. The composite article recited in claim 27, further comprises a radical generating compound selected from the group consisting of triallyl isocyanurate, triallylcyanurate, trimethylpropane trimethacrylate, decamethylene glycol dimethacrylate, divinylbenzene, diallylphthalate, diallyl maleate, pentaerythritol triacrylate, trimethylolpropane triacrylate, trimethylolpropane trimethacrylate, or mixtures thereof.

31. The composite article recited in claim 1, wherein at least one layer selected from said first polymeric and said third polymeric layers further comprise antimony oxide or zinc oxide.

32. The composite article recited in claim 1, wherein at least one layer selected from said first polymeric, said second polymeric and said third polymeric layers further comprise a hindered phenolic antioxidant.

33. The composite article recited in claim 1, wherein said second polymeric layer further comprises zinc salt of 2-methylmercaptobenzimidazole.

34. The composite article recited in claim 1, further comprising at least one adhesion-promoting layer between adjacent layers of said first, second, and third polymeric layers.

35. The composite article as recited in claim 34, wherein said adhesion-promoting layer is less than 0.08 mm thick.

36. A high-temperature, automotive-wire article having an operative temperature exceeding that of at least 145° C., comprising:

an uncoated copper core; and an integrally bonded composite insulation disposed over said uncoated copper core, comprising a fluorocarbon material forming an inner layer surrounding said copper core, a polyethylene material forming an intermediary layer disposed over said inner layer, and a second fluorocarbon material forming an outer layer disposed over said intermediary layer, said integrally bonded composite insulation having a total wall thickness of less than approximately 0.5 mm and an operative temperature exceeding 145° C.

37. The automotive wire recited in claim 36 wherein at least one of said layers is irradiated by an electron beam.

* * * * *